United States Patent [19]

Jarman

[11] 3,992,921

[45] Nov. 23, 1976

[54] BODY SILL CLAMP

[75] Inventor: Davis R. Jarman, Brunswick, Ga.

[73] Assignee: Virgil Hinson, Brunswick, Ga. ; a part interest

[22] Filed: July 16, 1975

[21] Appl. No.: 596,369

[52] U.S. Cl. ..... 72/457; 269/257; 24/243 B; 72/385; 72/705; 72/462

[51] Int. Cl.[2] ..... B21D 1/12

[58] Field of Search ..... 72/308, 309, 304, 312, 72/313, 372, 373–375, 381, 378, 385, 457, 460, 462; 269/266, 257, 270, 54.1, 54.2, 54.3; 83/450, 451, 456, 459, 460–466, 175, 176; 24/243 B, 243 GC; 26/62 A, 62 B, 62 C

[56] References Cited

UNITED STATES PATENTS

| | | | |
|---|---|---|---|
| 2,855,972 | 10/1958 | Greider | 72/705 X |
| 2,956,458 | 10/1960 | Hougen | 72/705 X |
| 3,111,159 | 11/1963 | Jenkins | 72/705 X |
| 3,241,352 | 3/1966 | Lincourt | 72/705 X |
| 3,258,821 | 7/1966 | Curran | 24/243 B |
| 3,531,971 | 10/1970 | Robb et al. | 72/385 |
| 3,827,279 | 8/1974 | Buske | 72/705 X |
| 3,879,813 | 4/1975 | Shadwell | 24/243 GC |

*Primary Examiner*—Milton S. Mehr
*Assistant Examiner*—D. M. Gurley
*Attorney, Agent, or Firm*—Clarence A. O'Brien; Harvey B. Jacobson

[57] ABSTRACT

A body sill clamp having first and second plates connectible to a pulling device and embraced and selectively drawn together by jaws adjustably connected to one another as by a bolt and nut. Teeth provided with square points are replaceably arranged on the plates so as to be retained by the jaws, with the teeth of one of the plates being offset from the teeth of the other of the plates such that the teeth can penetrate more of the metal being held, and can resist becoming clogged or stopped up.

9 Claims, 5 Drawing Figures

BODY SILL CLAMP

BACKGROUND OF THE INVENTION

1. Field of the Invention

This invention relates generally to a sheet metal clamp, and particularly to a body sill clamp for use in straightening the sheet metal and frame of a car in any body shop.

2. Description of the Prior Art

A problem arises during the straightening of sheet metal and the frame of conventional automobiles, and the like, requiring body work with regards to obtaining a good grip on the sheet metal or frame element being straightened. This is particularly a problem when gripping sheet metal along an edge thereof, since the metal tends to tear-out or slip from between the gripping elements.

U.S. Pat. No. 3,108,629, issued Oct. 29, 1963, to V. J. Jenkins, discloses a body clamp which employs a plurality of pins to help retain a piece of sheet metal, and the like, in a longitudinal channel provided in a clamping head of the device. Dimples disposed in the channel permit the pins to penetrate the sheet material being clamped, although this one-way penetration has been found unsatisfactory in some instances. U.S. Pat. No. 3,131,747, issued May 5, 1964, to E. J. Junkins, discloses a clamp assemblage in which the clamp jaws are provided with gripping teeth capable of exerting forces in different directions on a piece of sheet metal being gripped by the clamp. This known clamp assemblage, however, employs a pivoted moving jaw that somewhat limits the versatility of the device. Further, special gripping teeth need necessarily be employed with this known clamp assemblage.

A more recent development and the approach which is conventionally employed is shown in U.S. Pat. No. 3,827,279, issued Aug. 6, 1974, to E. Buske. The known wedge-tight clamp shown in this prior patent, however, does away with the penetrating teeth, and substitutes instead some protuberances that actually decrease the amount of clamping area of the jaws of the device.

Thus, while the clamping devices that do not provide for penetration of the metal, and the like, that are being gripped may have greater resistance to wear than devices which provide for penetration of the metal, the devices that merely grip the metal generally do not provide sufficient gripping force to achieve satisfactory results. The clamping devices which penetrate the sheet metal, on the other hand, tend toward high wear, short life, and resulting higher cost that has made them somewhat unpopular.

I am aware of the following additional U.S. Pat. Nos. that may be pertinent to the invention:

949,096 - Feb. 15, 1910
2,915,277 - Mar. 26, 1940
3,463,477 - Aug. 26, 1969
3,463,479 - Aug. 26, 1969

SUMMARY OF THE INVENTION

It is an object of the present invention to provide a body sill clamp which uses inexpensive, easily replaceable, gripping teeth capable of penetrating the sheet metal, and the like, being held.

It is another object of the present invention to provide a body sill clamp that may be used on either sheet metal or frame elements of an automobile being straightened in a body shop, and the like.

It is a still further object of the present invention to provide a sheet metal clamp having greater holding area than known clamps of this general kind.

It is yet another object of the present invention to provide a sheet metal clamp having teeth which penetrate the sheet metal, but resist clogging and stopping-up when compared to known clamps of this kind.

These and other objects are achieved according to the present invention by providing a body sill clamp having: first and second plates provided with eyes for facilitating attachment of the plates to a conventional pulling device, the plates being disposed in substantially parallel, adjacent relation; clamp jaws arranged embracing the first and second plates for selectively drawing the plates together; and removable teeth associated with the plates, each of the plates having at least one of the teeth associated therewith, with the teeth being arranged for penetrating metal being gripped by the plates, the teeth being offset from one another for facilitating penetration of the teeth through the metal being gripped in order to hold more of the metal and resist clogging or stopping-up as by loading up with paint, and the like.

Preferably the first and second plates are each provided with a plurality of apertures, and the teeth are removably disposed in the apertures, with the teeth mounted on one of the plates being arranged pointing toward but offset from the teeth mounted on the other of the plates along a common plane.

A particularly advantageous feature of the present invention provides the teeth with a pointed or tapered, end having a substantially square cross-section in order to permit the teeth to hold, for example, 30% more metal than teeth with, for example, points having round corss-sections. A head attached to a shank of the tooth permits retention of the tooth within the associated aperture provided in a respective one of the plates.

Each of the clamp jaws is preferably an elongated element provided with a substantially planar ledge arranged for receiving the heads of teeth arranged in apertures of a one of the plates disposed adjacent to and abutting the respective jaws and retaining the teeth in the plate when the jaws are biasing the plates toward one another in order to clamp a piece of sheet metal, and the like, between the plates. This biasing is advantageously accomplished as by a bolt and nut arrangement, with the bolt passing through the jaws and plates and the distance between a head of the bolt and the nut being variable in order to move the plates towards one another as desired.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
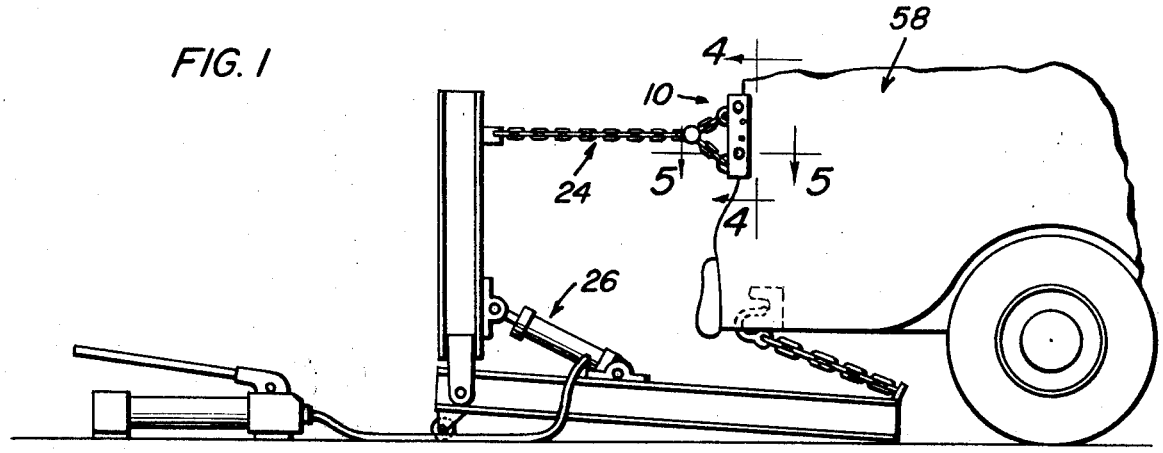
FIG. 1 is a fragmentary, schematic, side elevational view, showing a body sill clamp according to the present invention being used in conjunction with a conventional pulling device in order to straighten crumpled body metal of an automobile.
Figure 2:
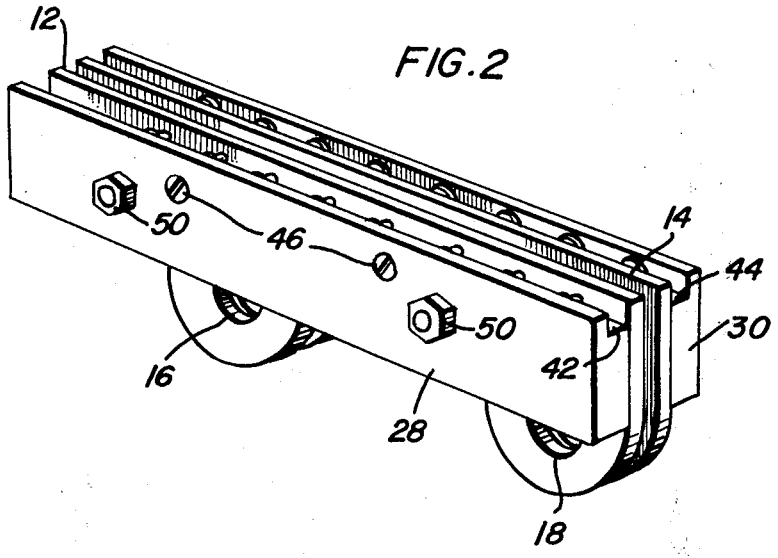
FIG. 2 is a perspective view showing a body sill clamp according to the present invention.
Figure 3:
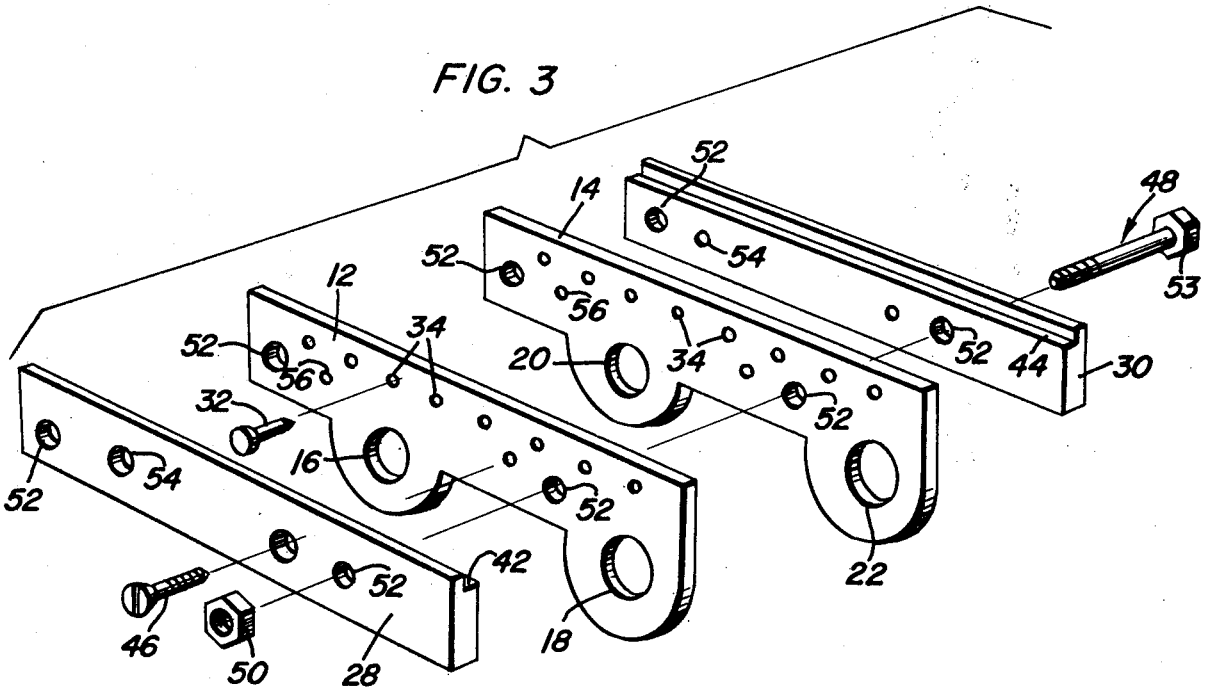
FIG. 3 is an exploded, perspective view, with some parts removed, showing the body sill clamp of FIG. 2.

Referring now more particularly to FIGS. 1 through 3 of the drawings, a body sill clamp 10 according to the present invention includes first and second plates 12 and 14 each provided with openings 16, 18 and 20, 22, respectively, for facilitating attachment of plates 12, 14 to a flexible member, such as a chain 24 which is in turn connected to the lever arm of a conventional pulling device 26. This attachment of chain 24 to openings 16, 18 and 20, 22 and to pulling device 26 is generally done in a conventional manner, the specific manner of attachment will not be set forth in detail herein.

Clamping elements in the form of first and second jaws 28 and 30 are arranged embracing plates 12 and 14 for selectively drawing plates 12, 14 together as desired. The preferred construction of jaws 28, 30 will be described in detail below.

Figure 4:
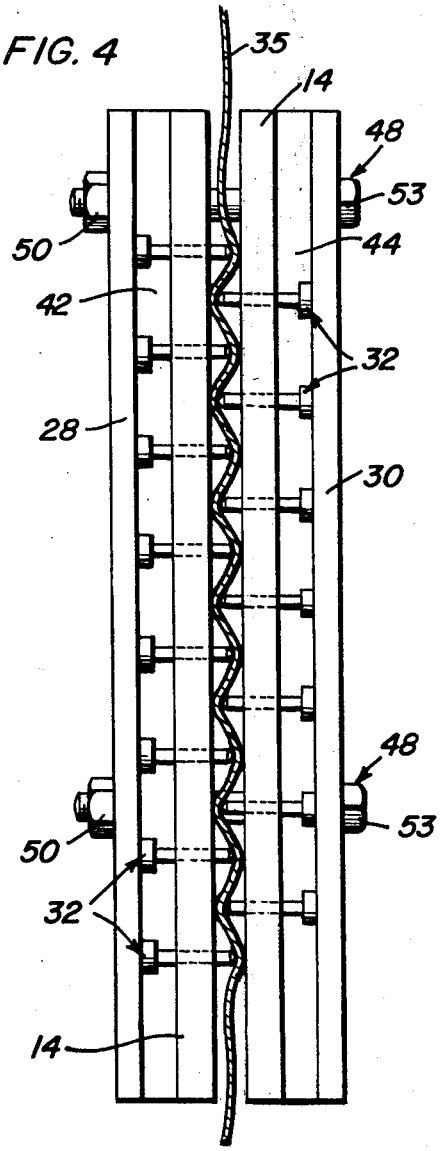
FIG. 4 is a fragmentary, sectional view taken generally along the line 4—4 of FIG. 1, but drawn to a larger scale.
Figure 5:
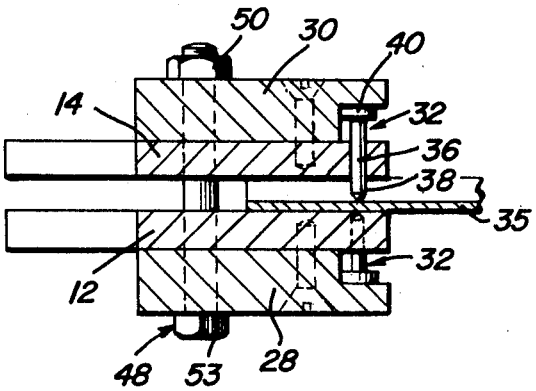
FIG. 5 is a fragmentary, sectional view taken generally along the line 5—5 of FIG. 1, but drawn to a larger scale.

Referring now more particularly to FIGS. 4 and 5 of the drawings, a plurality of teeth 32 are associated with plates 12 and 14. Each of the plates 12, 14 has at least one of the teeth 32 associated therewith, and preferably a plurality of teeth, as illustrated. The pointed teeth 32 are removably disposed in a plurality of apertures 34 provided in the plates 12, 14, with the teeth 32 mounted in one of the plates 12, 14 being arranged pointed toward, but offset from, the teeth 32 mounted on the other of the plates 14, 12 and arranged along a common plane for penetrating metal 35 being gripped by the plates 12, 14.

Each of the teeth 32 includes a shank 36 having a tapered end portion 38 of substantially square cross-section, and a head 40 attached to shank 36 at a point on shank 36 spaced from the tapered end portion 38. By providing end portion 38 with a substantially square cross-section, teeth 32 are able to hold, for example, 30% more of metal 35 than teeth (not shown) provided with substantially round end portions or points.

As perhaps can best be seen from FIGS. 3 through 5 of the drawings, each of the jaws 28, 30 is in the form of an elongated element provided with a ledge 42, 44 arranged for receiving the head 40 of teeth 32 arranged in apertures 34 of a one of the plates 12, 14 disposed adjacent to and abutting the jaws 28, 30 for retaining the teeth 32 in the associated plates 12, 14.

Fasteners are provided for removably attaching each of the jaws 28, 30 to an associated, adjacent one of the plates 12, 14, and pressure devices are also provided for adjustably attaching the jaws 28, 30 to one another in order to permit jaws 28, 30 to be moved toward and away from one another for clamping and unclamping plates 12, 14 against metal 35 being straightened.

Advantageously, the fasteners are in the form of the illustrated screws 46, while the pressure devices are in the form of the illustrated bolts 48 and associated nuts 50. Only one screw 46 and bolt and nut 48, 50 are shown in FIG. 3 for simplicity. As will be appreciated, bolts 48, which are advantageously arranged in the passage formed by a plurality of holes 52 formed in the various plates 12, 14 and jaws 28, 30 with the associated nut 50 being selectively tightened and untightened on the adjacent jaw, jaw 28 being illustrated, in order to cooperate with the head 53 of the associated bolt 48 and tighten the jaws 28 and 30 and plates 12, 14 against the head 53 so as to bring plates 12, 14 toward one another and cause teeth 32 to penetrate metal 35. As perhaps can best be seen from FIG. 3, screws 46 pass through ports 54 provided in jaws 28, 30 and thread into internally screw-threaded bores 56 provided in plates 12 and 14 in order to attach the latter to an associated one of the jaws 28, 30.

As will be appreciated, the easily replaceable teeth 32 will penetrate into metal 35, as for example the fender of a car 58 (FIG. 1) and securely retain the piece of metal so that same may be straightened as by a conventional pulling device 26. Further, teeth 32 are advantageously in the form of conventional nails available at a hardware store, and the like, so as to be obtainable at minimum cost.

Assembly and Operation

Teeth 32 are driven into apertures 34 provided in plates 12 and 14, and then are clamped to jaws 28 and 30, respectively, as by the illustrated screws 46 arranged in the associated countersunk ports 54 and threaded bores 56. The jaw halves thus formed are then installed on an auto frame or other sheet metal by clamping the sub-assemblies together as with bolts 48 and associated nuts 50. Openings 16, 18 and 20, 22 are deliberately arranged off center with respect to plates 12, 14 so that during pulling one clamp will pull tighter than the other forcing teeth 32 to move in one plate ahead of the other plate forming offset in metal clamp between plates 12, 14. This gives more holding power on the frame and also due to the square cross-section of the end portion of teeth 32, which makes square holes in the metal, results in, for example, 30% more holding power of clamp 10. Teeth 32 punch holes in metal 35, and since they are staggered will not tend to load up with paint, and the like, as other clamps do and become clogged and stopped-up.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

I claim:

1. A body sill clamp, comprising, in combination:

a. first and second plates provided with connecting means for attachment to a pulling device, the plates disposed in substantially parallel, adjacent relation;

b. clamp means arranged embracing the first and second plates for selectively drawing the plates together; and c. projecting means including a plurality of teeth, each of the plates having at least one of the teeth mounted thereon, for penetrating metal arranged between the plates, the teeth of each of the plates being offset from one another, the first and second plates being each provided with an aperture, and the projecting means including a tooth removably disposed in the aperture, with the tooth mounted on one of the plates being arranged pointing toward, but offset from, the tooth mounted on the other of the plates, each tooth being arranged along a plane parallel with the plane of the other tooth; the teeth each including a shank having an end portion of and a head attached to the shank at a point of the shank spaced from the end portion, the clamp means including first and second jaws, each of the jaws comprising an elongated element provided with a ledge forming a lip and arranged for receiving the head of the tooth disposed in the aperture of one of the plates disposed adjacent and abuting the respective jaw and retaining the tooth in the plate, the lip forming an abutment for the head of the tooth.

2. A structure as defined in claim 1, wherein the means for attachment includes openings arranged in the plates, and offset relative to an axis of symmetry of the plates, for attaching the plates to a flexible member of the pulling device.

3. A structure as defined in claim 1, wherein fastener means are provided for removably attaching each of the jaws to an associated, adjacent one of the plates, and also pressure means for adjustably attaching the jaws to one another and permitting the jaws to be moved toward and away from one another and, simultaneously, moving the plates toward and away from metal being clamped.

4. A structure as defined in claim 3, wherein the pressure means includes a headed bolt and cooperating nut, and wherein mating holes are provided in the jaws and plates, with the bolt being arranged in the passage formed by the holes and the nut selectively tightening the plates and teeth by threaded engagement of the nut with the bolt and movement of the nut toward the head of the bolt.

5. A body sill clamp, comprising, in combination:

a. first and second plates provided with connecting means for attachment to a pulling device, the plates disposed in substantially parallel, adjacent relation;

b. clamp means arranged embracing the first and second plates for selectively drawing the plates together; and c. projecting means including a plurality of teeth, each of the plates having at least one of the teeth mounted thereon, for penetrating metal arranged between the plates, the teeth of each of the plates being offset from one another, the first and second plates being each provided with a plurality of apertures, and the projecting means including a plurality of pointed teeth removably disposed in the apertures, with the teeth mounted on one of the plates being arranged pointing toward, but offset from, the teeth mounted on the other of the plates, the teeth being arranged along a common plane, the teeth each including a shank having a tapered end portion of substantially square cross-section, and a head attached to the shank at a point of the shank spaced from the tapered end portion, the clamp means including first and second jaws, each of the jaws comprising an elongated element provided with a ledge forming a lip and arranged for receiving the heads of teeth disposed in apertures of one of the plates disposed adjacent and abutting the respective jaw and retaining the teeth in the plate, the lip forming an abutment for the head of the teeth.

6. A structure as defined in claim 5, wherein fastener means are provided for removably attaching each of the jaws to an associated, adjacent one of the plates, and pressure means for adjustably attaching the jaws to one another and permitting the jaws to be moved toward and away from one another and, simultaneously, moving the plates toward and away from metal being clamped.

7. A structure as defined in claim 6, wherein the pressure means includes a headed bolt and cooperating nut, and wherein mating holes are provided in the jaws and plates, with the bolt being arranged in the passage formed by the holes and the nut selectively tightening the plates and teeth by threaded engagement of the nut with the bolt and movement of the nut toward the head of the bolt.

8. A structure as defined in claim 7, wherein the means for attachment includes openings arranged in the plates, and offset relative to an axis of symmetry of the plates, for attaching the plates to a flexible member of the pulling device.

9. A structure as defined in claim 5, wherein the means for attachment includes openings arranged in the plates, and offset relative to an axis of symmetry of the plates, for attaching the plates to a flexible member of the pulling device.

* * * * *